US010222175B2

(12) United States Patent
Couce

(10) Patent No.: US 10,222,175 B2
(45) Date of Patent: Mar. 5, 2019

(54) ROBOT/DRONE MULTI-PROJECTILE LAUNCHER

(71) Applicant: Gonzalo Couce, Grimsby (CA)

(72) Inventor: Gonzalo Couce, Grimsby (CA)

( * ) Notice: Subject to any disclaimer, the term of this patent is extended or adjusted under 35 U.S.C. 154(b) by 17 days.

(21) Appl. No.: 15/671,954

(22) Filed: Aug. 8, 2017

(65) Prior Publication Data

US 2018/0045485 A1 Feb. 15, 2018

Related U.S. Application Data

(60) Provisional application No. 62/372,546, filed on Aug. 9, 2016.

(51) Int. Cl.

| | |
|---|---|
| ***F41F 1/08*** | (2006.01) |
| ***F41G 5/18*** | (2006.01) |
| ***F41A 9/47*** | (2006.01) |
| ***F41A 17/72*** | (2006.01) |
| ***F41A 19/59*** | (2006.01) |
| ***F41A 27/06*** | (2006.01) |
| ***F41G 3/16*** | (2006.01) |
| ***F41G 5/06*** | (2006.01) |
| ***F41G 5/14*** | (2006.01) |

(52) U.S. Cl.

CPC ..... *F41F 1/08* (2013.01); *F41A 9/47* (2013.01); *F41A 17/72* (2013.01); *F41A 19/59* (2013.01); *F41A 27/06* (2013.01); *F41G 3/165* (2013.01); *F41G 5/06* (2013.01); *F41G 5/14* (2013.01); *F41G 5/18* (2013.01)

(58) Field of Classification Search

USPC ..... 89/37.01, 37.16

See application file for complete search history.

(56) References Cited

U.S. PATENT DOCUMENTS 1,892,914 A * 1/1933 Trimbach ..... F41A 23/00 89/37.16
1,902,107 A * 3/1933 Trimbach ..... B64D 7/02 89/37.16

(Continued)

FOREIGN PATENT DOCUMENTS

| | | |
|---|---|---|
| GB | 2186355 | 8/1987 |
| WO | 200101060 | 1/2001 |

*Primary Examiner* — Joshua E Freeman
*Assistant Examiner* — Bridget A Cochran
(74) *Attorney, Agent, or Firm* — Robert M. Downey, P.A.

(57) ABSTRACT

A multi-projectile launcher capable of firing less-lethal 40 mm rounds or high explosive 40 mm rounds (i.e., HE Grenades) can be attached to robots, drones, vehicles and stationary structures. The robot/drone multi-projectile launcher is remote controlled and capable of 360 degree horizontal rotation as well as vertical panning, and is able to quickly turn and acquire targets. A solenoid controlled firing system for each barrel includes a firing pin, trigger lever and striker, as well as a lockout bar and striker seer to prevent accidental firing (e.g., from impact or sudden jolt). Target acquisition systems include an infrared laser system, a standard red laser system, and an optic targeting system that is monitored through an onboard camera. A wireless network access device allows for remote viewing of live-feed camera images (still frame and video) and control of the optic targeting system, as well as the launcher articulation and firing.

8 Claims, 9 Drawing Sheets

(56) References Cited

U.S. PATENT DOCUMENTS 2,220,663 A * 11/1940 Rossmanith ..... F41A 19/03 89/131
2,254,678 A * 9/1941 Frise ..... F41A 27/22 297/344.16
2,281,772 A * 5/1942 Klemperer ..... F41G 5/14 89/205
2,322,455 A * 6/1943 Klemperer ..... F41G 5/18 74/471 R
2,358,105 A * 9/1944 Scott-Paine ..... F41A 27/06 396/426
2,437,463 A * 3/1948 Ford ..... F41G 5/18 89/202
2,464,195 A * 3/1949 Burley ..... F41G 1/30 356/29
2,564,698 A * 8/1951 Hammond, Jr. ..... F41G 5/18 235/404
2,752,825 A * 7/1956 Crigger ..... F41F 1/08 89/1.41
2,926,348 A * 2/1960 Asquith ..... F41G 5/18 318/581
2,949,825 A * 8/1960 Walton ..... F41A 21/08 42/111
3,115,062 A * 12/1963 Tassie ..... F41A 25/10 89/37.01
3,135,955 A * 6/1964 Brainin ..... F41G 5/18 244/177
3,181,147 A * 4/1965 Crawford ..... F41G 5/18 342/61
4,386,848 A * 6/1983 Clendenin ..... F41G 3/165 356/5.01
4,488,249 A * 12/1984 Baker ..... F41G 5/18 348/169
4,498,038 A * 2/1985 Malueg ..... B64D 47/08 248/550
4,549,184 A * 10/1985 Boles ..... F41G 5/18 342/107
5,088,818 A * 2/1992 Nicholson ..... F41G 7/263 244/3.13
5,197,691 A * 3/1993 Amon ..... F41G 3/165 244/3.13
5,452,640 A * 9/1995 Bovee ..... F41F 1/08 89/1.815
5,542,334 A * 8/1996 Wells ..... F41G 7/007 244/3.12
6,176,169 B1 * 1/2001 Rostocil ..... B64D 7/00 42/25
6,250,196 B1 * 6/2001 Sanderson ..... B64D 7/02 89/37.16
6,591,535 B2 * 7/2003 Reynolds ..... F41A 3/38 42/105
6,729,223 B2 * 5/2004 De Lapasse ..... F41H 5/26 42/111
7,086,318 B1 * 8/2006 Darnall ..... F41A 23/42 89/1.815
7,202,809 B1 * 4/2007 Schade ..... F41A 1/08 244/3.1
7,237,468 B2 * 7/2007 Laine ..... F41A 19/68 89/37.05
7,431,247 B2 * 10/2008 Bobro ..... F41A 23/10 248/176.1
7,626,538 B2 * 12/2009 Rose ..... G01S 3/46 342/104
7,870,816 B1 * 1/2011 Willingham ..... F41G 3/06 89/204
8,082,832 B1 * 12/2011 Tidwell ..... F41H 11/02 89/1.11
8,434,397 B1 * 5/2013 Deckard ..... B64D 7/06 89/37.13
8,646,374 B2 * 2/2014 Shacklee ..... F41A 23/24 89/41.02
8,833,232 B1 * 9/2014 Fox ..... F41A 27/18 89/41.06
9,003,943 B2 * 4/2015 Lundqvist ..... G01S 13/78 89/1.11
9,103,628 B1 * 8/2015 Moraites ..... F41G 7/2293
9,146,251 B2 * 9/2015 Moraites ..... G06T 7/70
9,196,041 B2 * 11/2015 Moraites ..... H04N 5/23296
9,476,676 B1 * 10/2016 Greenslade ..... F41G 1/32
9,632,168 B2 * 4/2017 Moraites ..... G01S 5/00
9,714,815 B2 * 7/2017 Moraites ..... G01S 5/00
2004/0134340 A1 * 7/2004 Quinn ..... F41A 27/28 89/41.01
2010/0320312 A1 * 12/2010 Bril ..... F41G 7/008 244/3.16
2012/0042559 A1 * 2/2012 Bockmon ..... F41A 27/30 42/111
2012/0247317 A1 * 10/2012 Karakookly ..... F41A 23/24 89/127
2014/0251123 A1 * 9/2014 Venema ..... F41G 3/16 89/41.22
2016/0010940 A1 * 1/2016 Horvath ..... F41A 23/24 89/41.02

* cited by examiner

ROBOT/DRONE MULTI-PROJECTILE LAUNCHER

BACKGROUND OF THE INVENTION

This non-provisional patent application is based on provisional patent application Ser. No. 62/372,546 filed Aug. 9, 2016.

FIELD OF THE INVENTION

The present invention relates to a multi-projectile launcher and, more particularly, to a multi-projectile launcher that is capable for firing 40 mm rounds and which is adapted for attachment to robots, unmanned aerial vehicles (i.e., drones), ground vehicles and stationary structures.

DISCUSSION OF THE RELATED ART

Currently, there are single 40 mm projectile launchers that can be fixed to robots, vehicles and other structures. However, existing 40 mm projectile launchers are not capable of a multi-shot system, nor are they capable of articulating to quickly acquire targets. Moreover, existing 40 mm projectile launchers are not sufficiently light in weight to allow them to be attached to and carried by drones.

Accordingly, there remains a need for a fully articulating 40 mm projectile launcher capable of firing less-lethal 40 mm rounds or high explosive 40 mm rounds (i.e., HE Hand Grenades) and wherein the launcher is fully articulating, capable of firing multiple rounds and sufficiently light to allow for attachment to drones, as well as robots, vehicles, stationary poles and other structures.

There is a further need for a fully articulating multi-shot 40 mm projectile launcher that can be attached to drones, robots, vehicles, stationary poles and other structures, and which further includes a target acquisition system including an infrared laser system and a standard red laser system, as well as an optic targeting system that is monitored through an onboard camera. Moreover, there is a need for a lightweight 40 mm multi-shot projectile system that allows for 360 degree horizontal rotation and 180 degree vertical rotation and which is able to quickly turn and acquire targets for firing both less-lethal 40 mm rounds or high explosive 40 mm rounds.

BRIEF DESCRIPTION OF THE DRAWINGS

For a fuller understanding of the nature of the present invention, reference should be made to the following description taken in conjunction with the accompanying drawings in which.

Like reference numerals refer to like parts throughout the several views of the drawings.

DESCRIPTION OF THE PREFERRED EMBODIMENT

Referring to the several views of the drawings, the robot/drone multi-projectile 40 mm launcher assembly 10 of the present invention is shown in accordance with a preferred embodiment thereof.

Figure 1:
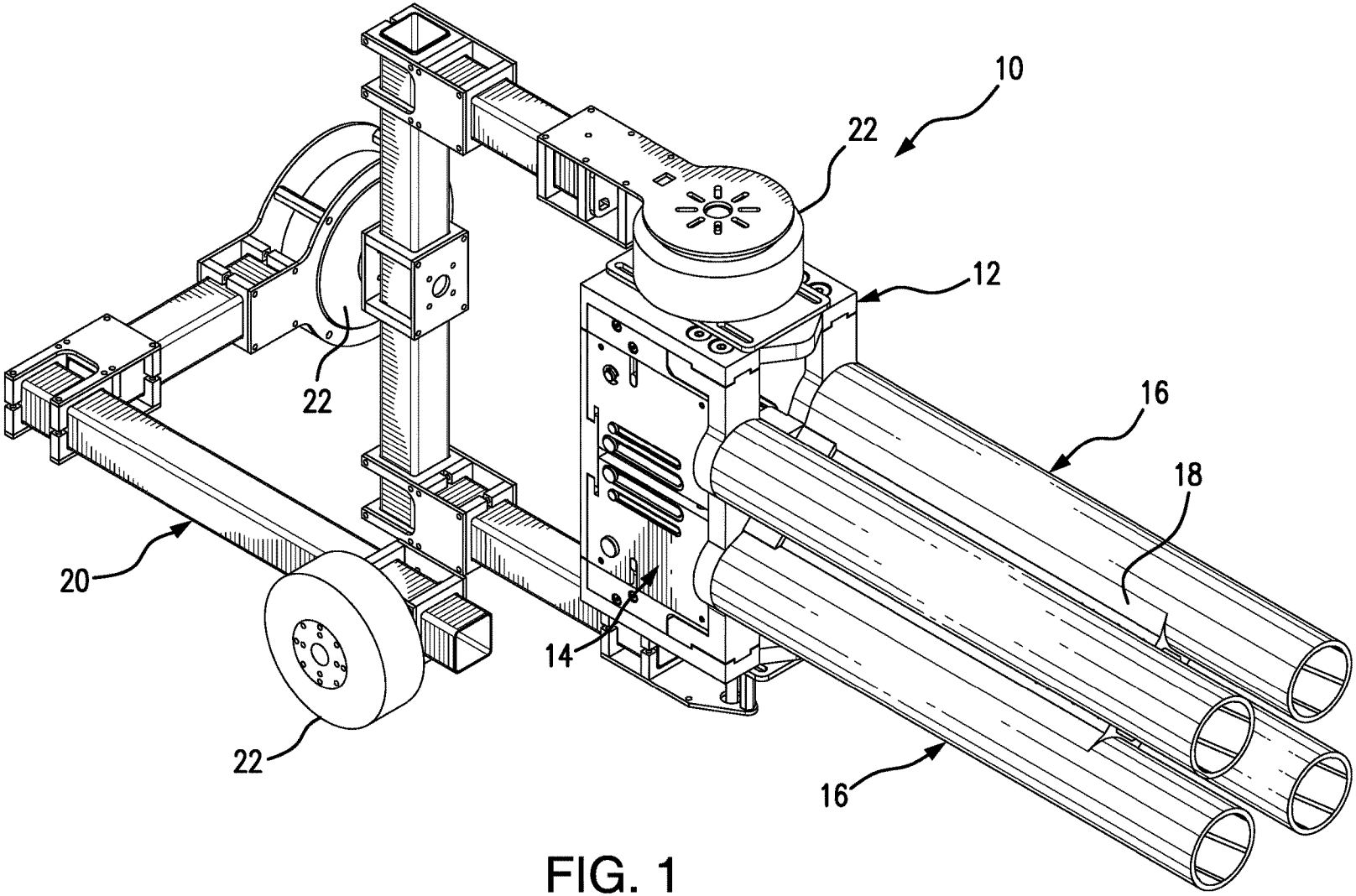
FIG. 1 is a front, side perspective view of the robot/drone multi-projectile 40 mm launcher of the present invention in accordance with a preferred embodiment thereof.
Figure 2:
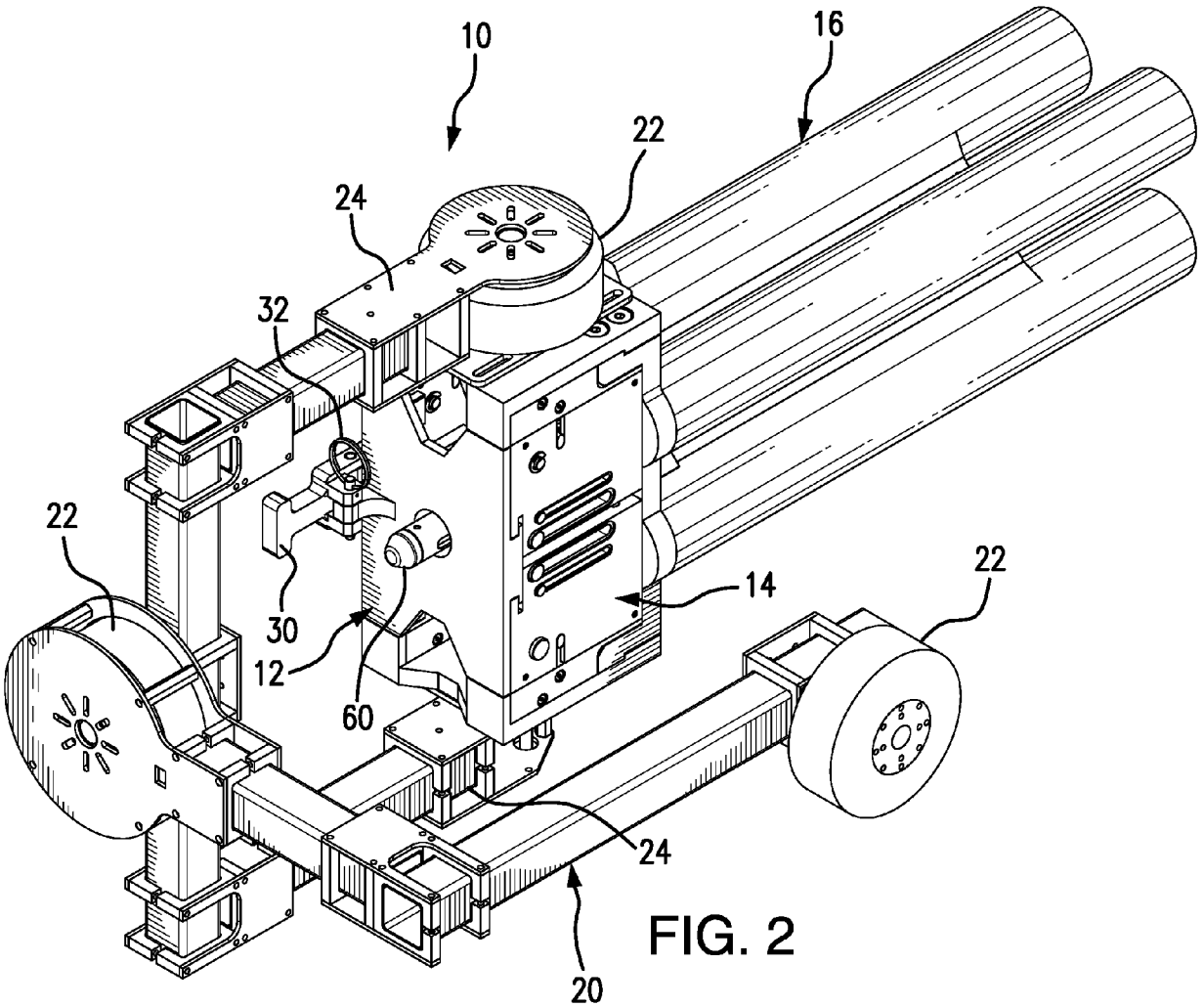
FIG. 2 is a top, rear perspective view of the robot/drone multi-projectile 40 mm launcher of the present invention.
Figure 3:
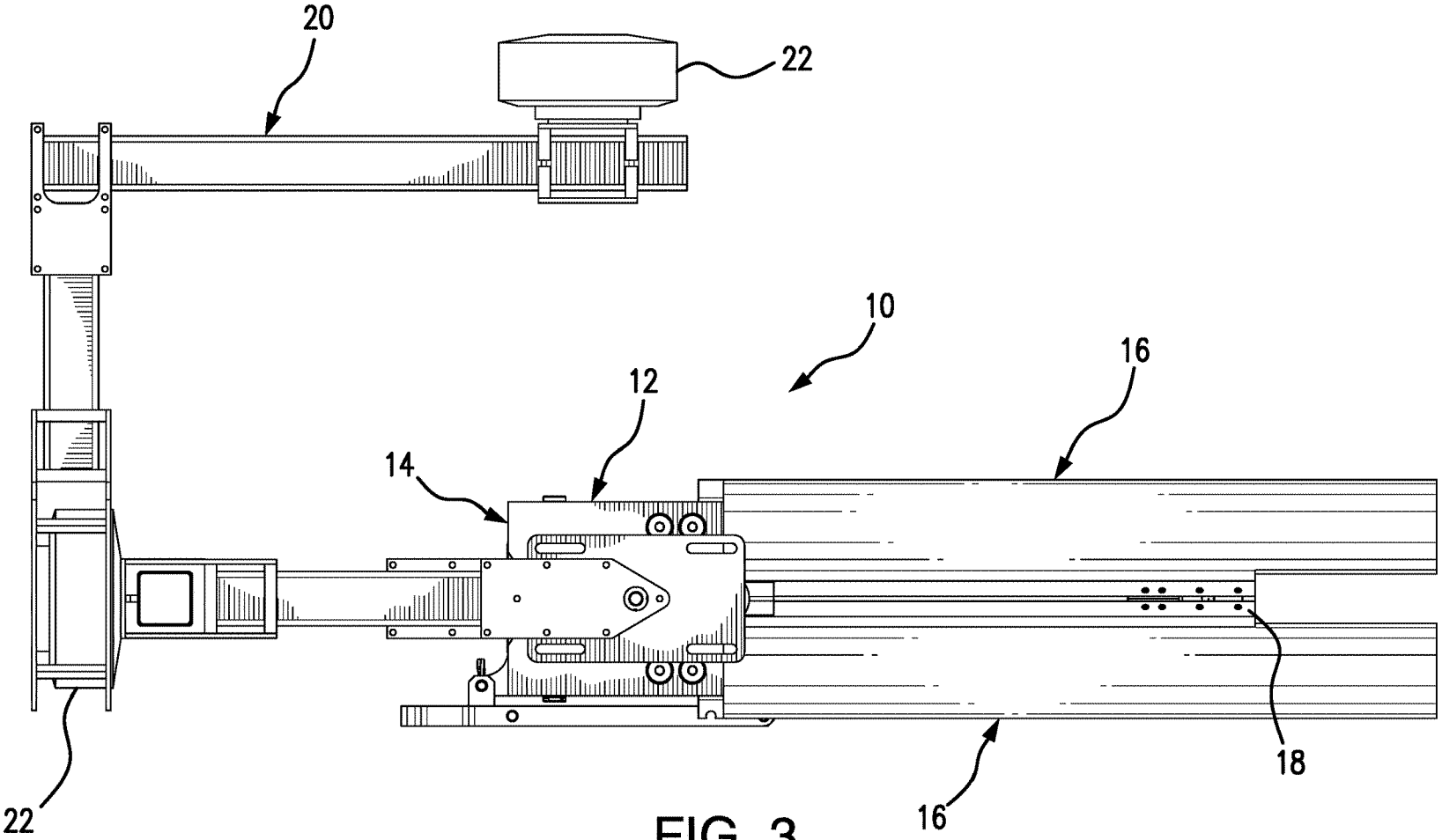
FIG. 3 is a side elevational view of the robot/drone multi-projectile 40 mm launcher of the present invention.
Figure 4:
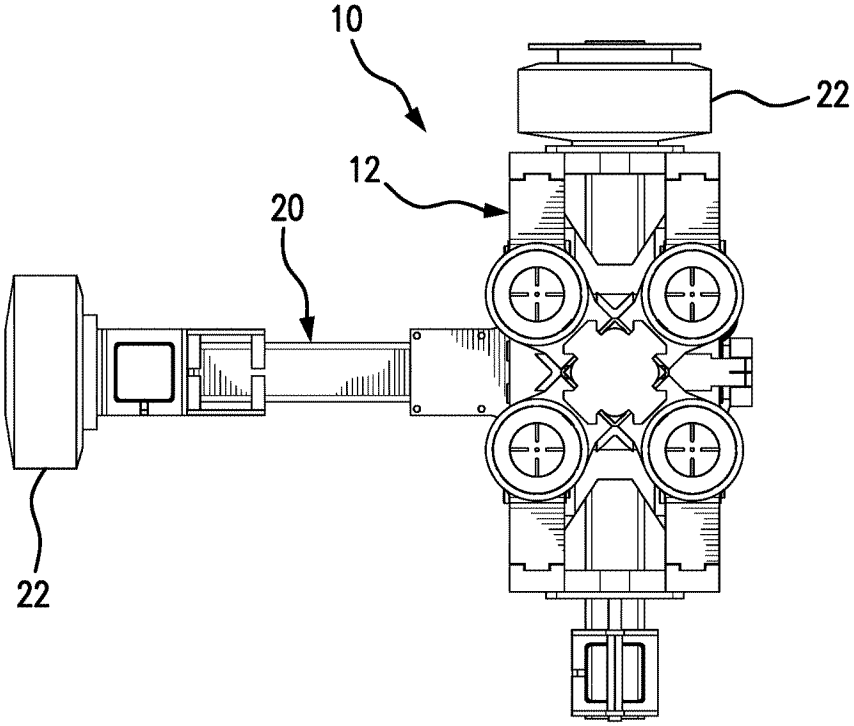
FIG. 4 is a front elevational view of the robot/drone multi-projectile 40 mm launcher of the present invention shown rotated 270 degrees from vertical.
Figure 5:
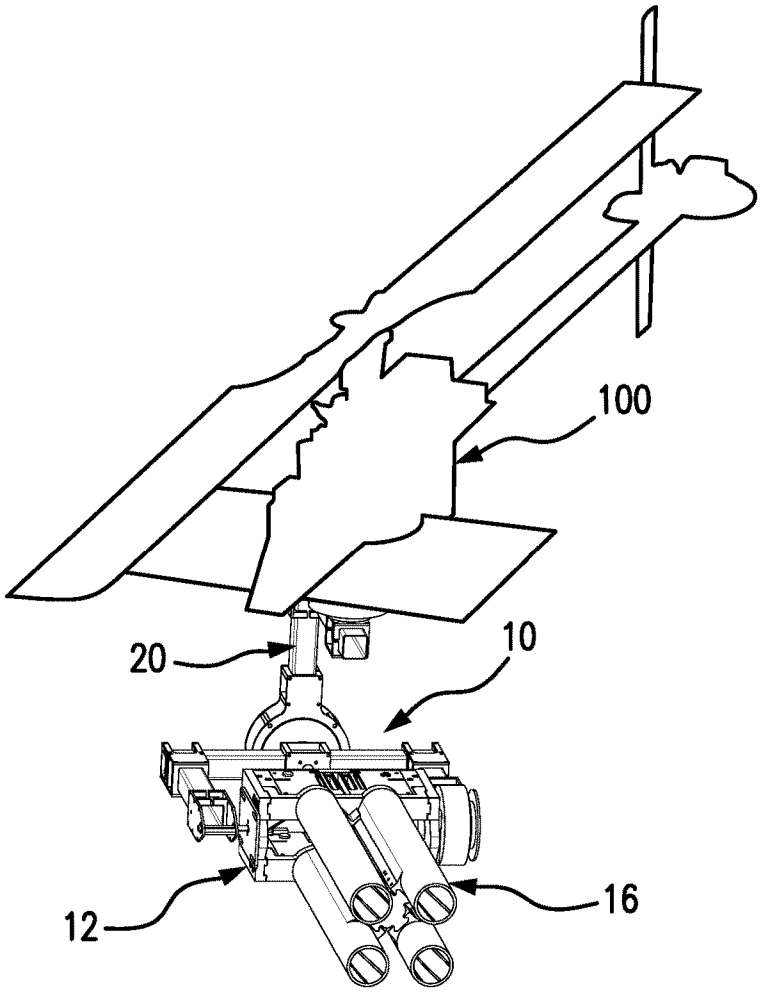
FIG. 5 is a front perspective view of the robot/drone multi-projectile 40 mm launcher of the present invention shown mounted to an unmanned aerial vehicle (i.e., drone)

The preferred embodiment of the launcher assembly 10 includes a launcher 12 and a gimbal assembly 20. The launcher 12 includes a primary launcher housing 14 containing the operation components of the launcher assembly 10, including a wireless communication device 70, a solenoid controlled firing system 40 for multiple rounds, target acquisition systems 80, a launcher articulation system 90, and an onboard camera 88. A multi-barrel arrangement 16 includes four barrels for firing up to four rounds of either a less-lethal 40 mm round or high explosive 40 mm rounds. The primary housing 14 and multi-barrel arrangement 16 are pivotally mounted on an articulating system that allows for both 360 degree horizontal pan and 180 degree vertical rotational movement. The target acquisition system 80 includes both an infrared laser system 82 and a standard red laser system 84 for acquiring targets. The target acquisition system further includes an optic targeting system 86 that is monitored through an onboard camera 88. The wireless communication device 70, such as a router, hotspot internet access device or RF signal transceiver allows for remote control and firing of the rounds (R), as well as live-feed camera images (still frame and video) and control of the optic targeting system 86, launcher articulation system 90 (i.e., horizontal and vertical panning) and operation of the firing system 40 to individually fire the rounds (R) from the four barrels. The rounds (R) are fired by operation of solenoids 42 that are controlled remotely. The system is made of a mix of lightweight aluminum or similar material allowing it to be lightweight and able to quickly turn and acquire targets. The lightweight system also allows it to be easily adapted for attachment to drones, as well as robots, vehicles, stationary poles and other structures. FIG. 5 shows an example of the multi-projectile launcher assembly mounted to an unmanned aerial vehicle 100 (i.e., drone).

Figure 6:
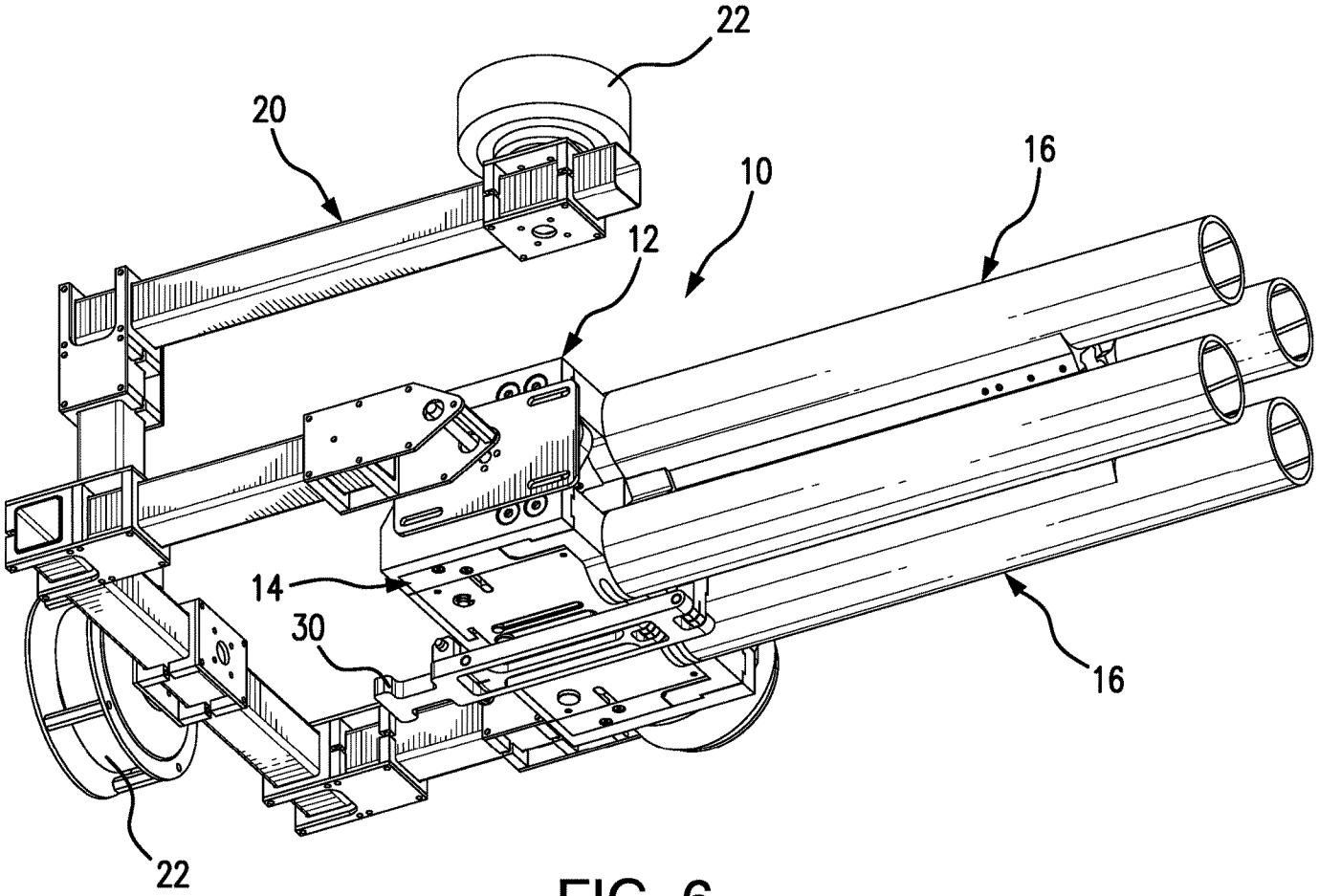
FIG. 6 is a front, bottom perspective view of the robot/drone multi-projectile 40 mm launcher of the present invention.
Figure 7:
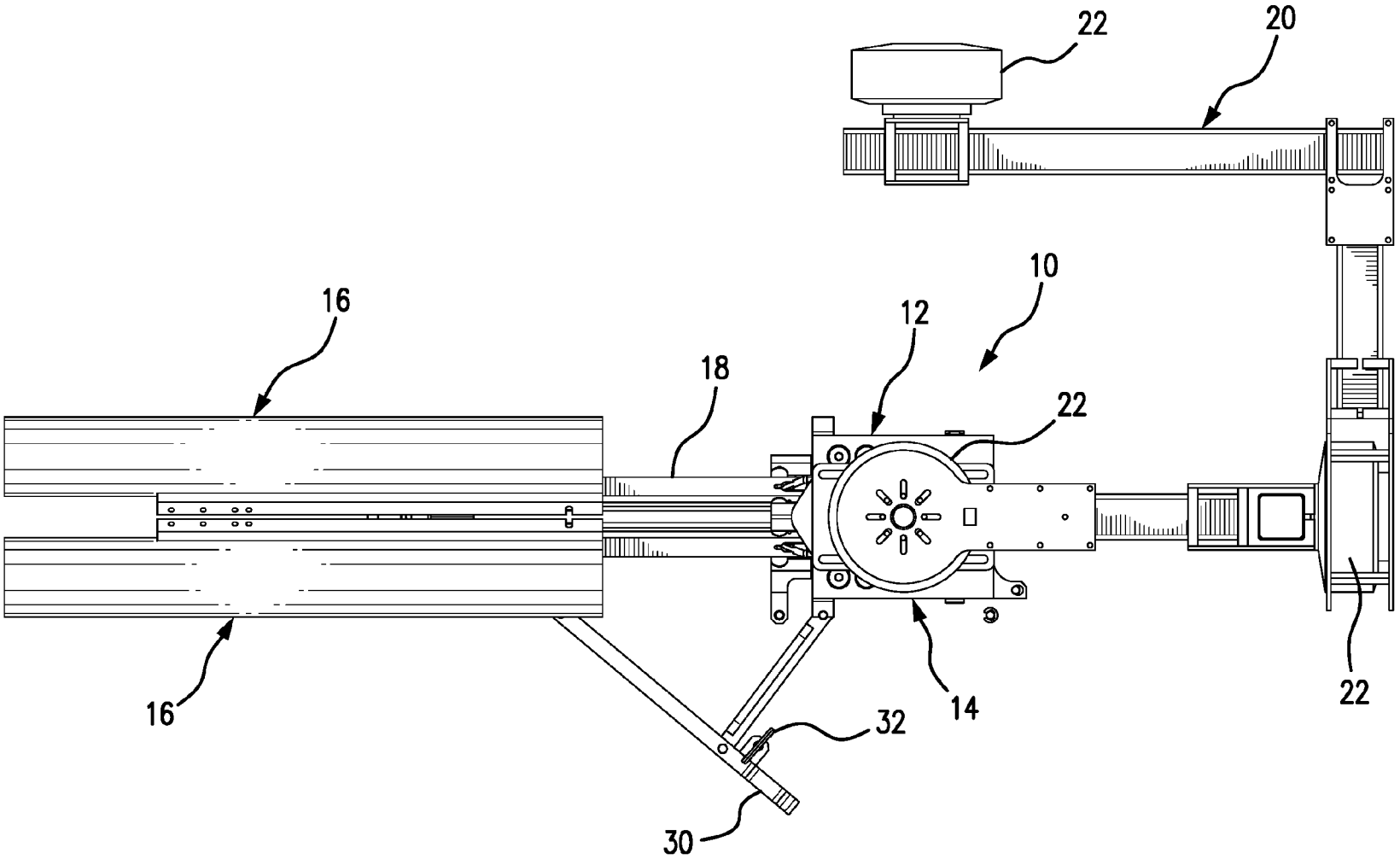
FIG. 7 is a left side elevational view of the robot/drone multi-projectile 40 mm launcher of the present invention shown with a multi-barrel assembly extended away from a firing system for ejection of spent 40 mm round casings and reloading of 40 mm rounds within the barrels.

The multi-barrel arrangement 16 is loaded by pulling the loading handle 30 down to cause the barrel arrangement 16 to move forward relative to the primary launcher housing 14. More specifically, the multi-barrel arrangement 16 is supported on a barrel guide and support beam 18 that extends from the front of the primary launcher housing 14. The barrel guide and support beam 18 is specifically structured to provide channels for congruent receipt of the cylindrical surfaces of the barrels therein, so that the barrel guide and support beam 18 serves as a track along which the multi-barrel arrangement 16 is able to slide. When the multi-barrel arrangement is extended out, by pulling the loading handle 30 down, as seen in FIG. 7, the spent round casings within the barrels are ejected from the back end of the barrels. New rounds can then be reloaded within the chambers of the barrels and the loading handle 30 is then moved up and collapsed against the bottom of the primary launcher housing 14, as seen in FIG. 6, causing the multi-barrel arrangement 16 to be pulled in and against the front side of the launcher housing 14 in direct communication with the firing system 40, and particularly the individual firing assemblies associated with each barrel and round (R). When the handle 30 is moved up to this position, as shown in FIG. 6, the rounds (R) are ready to fire. A locking pin 32 is then inserted through the loading handle 30 and a locking member extending from the launcher housing 14 to secure the loading handle 30 closed with the multi-barrel arrangement 16 in the cocked position in association with the firing system of the launcher assembly 10 and the rounds (R) ready to fire. Once the multi-barrel arrangement is cocked and loaded in this position, an indicator light 60 illuminates to indicate that the launch firing system is cocked and ready to fire.

Figure 8:
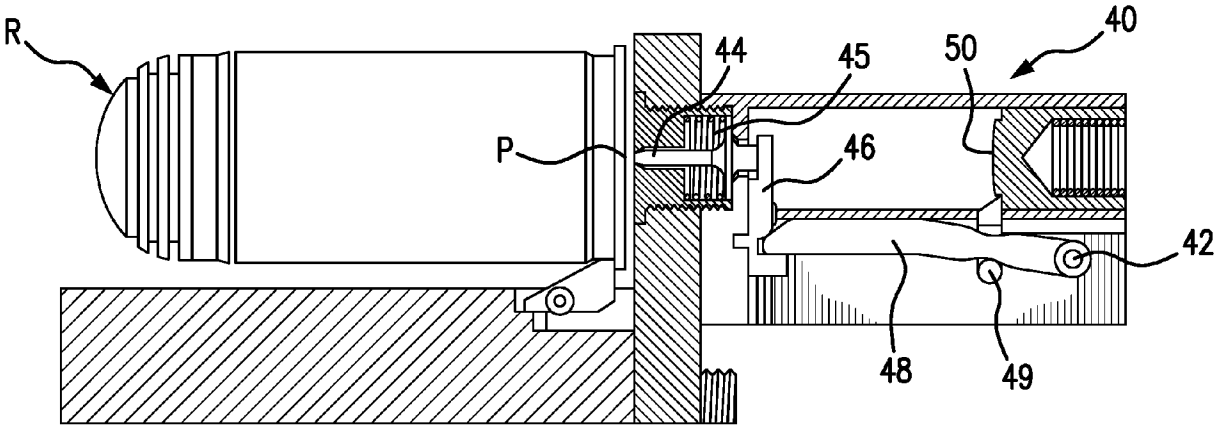
FIG. 8 is an isolated view in partial cross section showing a solenoid controlled firing system of the robot/drone multi-projectile 40 mm launcher of the present invention in relation to a 40 mm round loaded within one of the barrels of the multi-barrel assembly.
Figure 9:
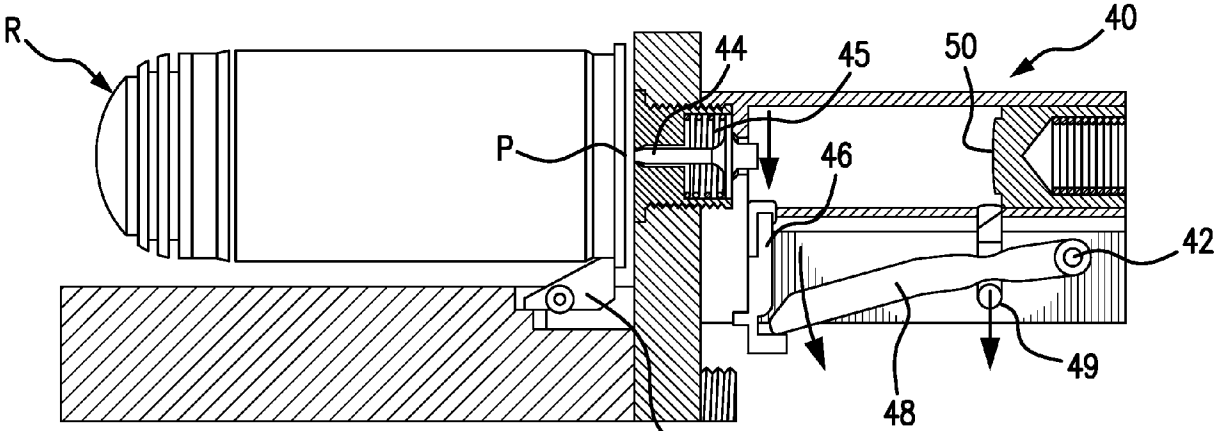
FIG. 9 is an isolated view in partial cross section showing a solenoid controlled firing system of the robot/drone multi-projectile 40 mm launcher of the present invention in relation to a 40 mm round loaded within one of the barrels of the multi-barrel assembly and wherein a trigger lever has been actuated by a solenoid to allow firing of the 40 mm round loaded in the barrel.
Figure 10:
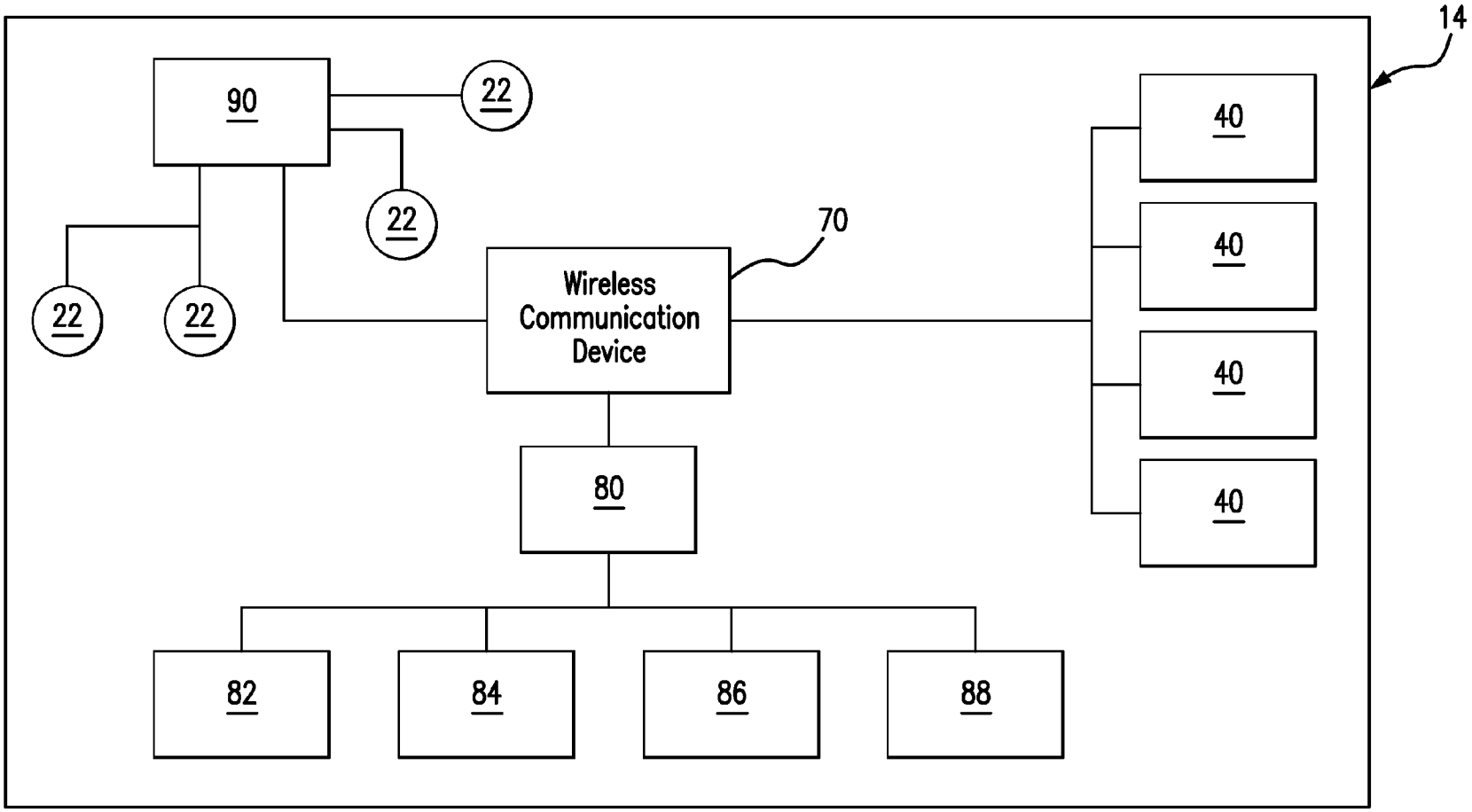
FIG. 10 is a schematic diagram illustrating the several onboard systems of the robot/drone multi-projectile 40 mm launcher including a wireless communication device, several target acquisition systems, a launcher articulation system, and a firing system.

Referring to FIGS. 8 and 9, a detailed illustration is provided of the firing system 40 associated with each barrel of the multi-barrel arrangement 16. Specifically, the firing system 40 associated with each barrel includes a solenoid 42 which is remotely activated via the wireless communication device 70. The firing system further includes a firing pin 42 that is held back by a light spring 45. The firing pin 44 is fairly light to ensure that it is not capable of initiating the primer (P) on the round (R) with an impact to the multi-projectile launcher assembly 10 (e.g., an impact to the drone). Thus, in the event of an impact with the drone, such as if the drone falls out of the sky, the firing pin will not ignite the primer (P) and accidentally fire the round (R). The firing pin 44 is protected by the lockout bar 46 which is offset from the firing pin 44, ensuring that no force is transferred through the firing pin 42 if the striker 50 accidentally trips. This lockout bar 46 will also be held in the locked position using a spring to ensure that it returns to this position when cocked. The lockout bar 46 is actuated by the trigger lever 48 which is operated in a pivoting movement by the solenoid 42. A striker seer 49 retains the striker 50 in the cocked position until the trigger lever 40 is actuated by the solenoid 42. This design ensures that the primer (P) on the round (R) cannot be struck and actuated by the firing pin 44 in the event of a sudden physical jolt, or even a momentary electrical impulse to the solenoid 42. The solenoid 42 needs to be energized for a specific period in order to ensure that the firing pin lockout bar 46 is moved out of the way when the striker 50 reaches the end of its travel. This provides mechanical safety, as well as a method to integrate electronic/program logic safety.

The launcher assembly 10 is placed on safe mode when there is a physical block preventing the striker from getting to the primer. Once the rounds have been fired, the loading handle 30 is pulled down, as described above, and the spent casings are automatically ejected by a spent round ejector member 52 which provides for the extracting and ejection system. The spent round ejector member 52 in each barrel moves into position once the round (R) is loaded into the chamber of the barrel and the loading handle 30 is locked in position, as described above.

The launcher 12 is mounted to an unmanned aerial vehicle (i.e., drone), robot, ground vehicle or other structure with the use of an articulating gimbal assembly 20. The gimbal assembly 20 includes an arrangement of servo-motors 22 that allow for horizontal and vertical rotational movement of the launcher 12, including the multi-barrel arrangement 16 and primary launcher housing 14 relative to the host structure (e.g., robot, drone, vehicle, etc.). Specifically, the servo-motors 22 are a part of the launcher articulation system 90 that is controlled via the wireless communication device 70. The optic target system 86 in association with the onboard camera 88 communicate with the wireless communication device 70 to allow for movement of the launcher articulation system 90 so that the rounds (R) can be fired at the appropriate target. Similarly, the other components of the target acquisition system 80, including the infrared laser system 82 and standard red laser system 84 allow for target acquisition and appropriate operation of the launcher articulation system 90, via the wireless communication device 70, to aim the multi-barrel arrangement 60 at the target and fire the one or more rounds (R) at the appropriate target. The gimbal assembly 20 is further provided with recoil shock absorbers 24 which assist in the launcher accuracy when firing at targets. The recoil shock absorption system may include rubber grommets that mortify the recoil of the fired rounds (R).

In one embodiment, the launcher 12 is particularly adapted for mounting to robots or drones and can fire at a distance of up to 14.4 miles from the operator. The operator has his own citing camera and fire control. The operation of the multi-projectile launcher assembly 10 is generally intended to be a two person operation, including a pilot and a fire control operator.

While the present invention has been shown and described in accordance with a preferred and practical embodiment, it is recognized that departures from the instant disclosure are fully contemplated within the spirit and scope of the invention which is not to be limited except as defined in the following claims.

What is claimed is:

1. A multi-projectile launcher assembly comprising:

a launcher structured and disposed for launching a plurality of 40 mm rounds of munitions, and the launcher including a primary launcher housing for containing operational components of the launcher, a multi-barrel arrangement movably supported on a barrel guide fixed to and extending from the primary launcher housing, and a gimbal assembly for mounting the launcher to a host;

the operational components contained in the primary launcher housing including a wireless communication device for transmitting and receiving signals in communication with a remote operator, a firing system for firing the multiple rounds of munitions from the multi-barrel arrangement, and at least one target acquisition system;

the gimbal assembly including a launcher articulation system for allowing 360 degree horizontal panning rotation of the launcher relative to the host and at least partial vertical up and down panning movement of the launcher relative to the host; and the multi-barrel arrangement being movable between a cocked and loaded position to maintain the plurality of rounds in direct firing association with the firing system in the primary launcher housing, and an extended position moved along the barrel guide and away from the primary launcher housing to allow for ejection of spent round casings and reloading of new rounds of munitions within the multi-barrel arrangement.

2. The multi-projectile launcher assembly as recited in claim 1 wherein the multi-barrel arrangement includes a plurality of individual barrels, each being structured for containing and firing one of the 40 mm rounds of munitions therefrom, and the firing system including a solenoid controlled firing assembly associated with each of the plurality of individual barrels.

3. The multi-projectile launcher assembly as recited in claim 2 wherein the solenoid controlled firing assembly associated with each of the plurality of individual barrels includes a solenoid, a trigger lever operated by the solenoid, a firing pin, a lockout bar and a striker for actuating the firing pin to fire the round of munition from the barrel and the lockout bar being structured to move into locking relation between the firing pin and the striker to prevent accidental firing of the round of munition.

4. The multi-projectile launcher assembly as recited in claim 3 wherein the at least one target acquisition system includes an infrared laser system.

5. The multi-projectile launcher assembly as recited in claim 4 wherein the at least one target acquisition system includes a standard red laser system.

6. The multi-projectile launcher assembly as recited in claim 5 wherein the at least one target acquisition system includes an optic target system.

7. The multi-projectile launcher assembly as recited in claim 6 further including an onboard camera communicating with the wireless communication device and the optic target system.

8. The multi-projectile launcher assembly as recited in claim 1 wherein the launcher articulation system includes a plurality of servo-motors.

* * * * *